US005123623A

United States Patent [19]

McNamara

[11] Patent Number: 5,123,623

[45] Date of Patent: Jun. 23, 1992

[54] POST ANCHORING DEVICE

[75] Inventor: James F. McNamara, Aldergrove, Canada

[73] Assignee: Nippon Steel Corporation, Tokyo, Japan

[21] Appl. No.: 651,651

[22] Filed: Feb. 6, 1991

[51] Int. Cl.[5] ..... F16M 11/00

[52] U.S. Cl. ..... 248/545; 248/156

[58] Field of Search ..... 248/156, 530, 532, 533, 248/545; 403/361; 256/1, 19

[56] References Cited

U.S. PATENT DOCUMENTS

| | | | |
|---|---|---|---|
| 181,826 | 9/1876 | Eanes | 248/156 |
| 284,219 | 9/1883 | Mehew . | |
| 396,624 | 1/1889 | Thomas . | |
| 1,999,925 | 4/1935 | Buzhardt | 248/156 |
| 3,724,145 | 4/1973 | Daniel . | |
| 3,809,346 | 5/1974 | Jackson | 248/530 |
| 3,977,654 | 8/1976 | Etherington et al. | 256/1 X |
| 4,007,902 | 2/1977 | Pettee | 248/530 X |
| 4,156,332 | 5/1979 | Thompson | 52/165 |
| 4,242,822 | 1/1981 | Black | 248/156 X |
| 4,455,795 | 6/1984 | Cole . | |
| 4,593,872 | 6/1986 | Svensson | 248/156 |
| 4,644,713 | 2/1987 | Lehman . | |
| 4,717,110 | 1/1988 | Fohrman | 248/533 X |
| 4,874,149 | 10/1989 | Miceli . | |
| 4,923,164 | 5/1990 | Stenberg | 248/156 X |
| 4,923,165 | 5/1990 | Cockman | 248/156 X |

FOREIGN PATENT DOCUMENTS

| | | | |
|---|---|---|---|
| 2539079 | 3/1977 | Fed. Rep. of Germany | 248/156 |
| 1557852 | 2/1969 | France | 248/530 |
| 7706355 | 12/1978 | Netherlands | 248/156 |
| 0581915 | 10/1946 | United Kingdom | 248/156 |

*Primary Examiner*—Ramon O. Ramirez
*Assistant Examiner*—Sarah A. Lechok
*Attorney, Agent, or Firm*—Wenderoth, Lind & Ponack

[57] ABSTRACT

An anchoring device for supporting a post in a generally upright, vertical position. The anchoring device includes a base plate having a surface area substantially greater than the cross-sectional surface area of the post to be supported, and a plurality of ground-penetrating stabilizing pins spaced near the perimeter of the base plate.

11 Claims, 2 Drawing Sheets

POST ANCHORING DEVICE

FIELD OF THE INVENTION

This application relates to an anchoring device for supporting a post in a generally upright, vertical position.

BACKGROUND OF THE INVENTION

Various devices are known in the prior art which are designed to eliminate the need to dig a hole in the ground in order to anchor a post in an upright, vertical position. For example, U.S. Pat. No. 284,219 which issued to Mehew on Sep. 4, 1883, discloses an anchoring socket for fence posts having a pair of vertical side plates extending upwardly from opposite sides of a base plate. Both side plates have apertures for insertion therethrough of bolts or other fasteners into a fence post placed between the side plates. The Mehew socket further includes a ground-penetrating stud projecting downwardly from the centre of the base plate, and a pair of arrow-shaped pins projecting downwardly from opposite sides of the base plate for anchoring the socket in the ground.

The primary drawback to the Mehew design is its relative instability. In particular, the surface area of the Mehew socket base plate is roughly equal to the cross-sectional surface area of the post to be supported. Since the weight of the post is supported by a relatively small foundation, the Mehew socket is not able to effectively resist twisting forces acting on the post, such as wind sheer. Although the Mehew socket may be suitable for small fence posts (which are also braced by siding extending between adjacent posts), it would not be suitable for anchoring relatively heavy highway sing posts and the like.

U.S. Pat. No. 396,624 which issued to Thomas on Jan. 22, 1889, discloses a post holder consisting of a socket mounted on a rectangular base plate having a surface area substantially larger than the post cross-sectional area. However, only a single, central ground-penetrating shaft extends downwardly from the base plate and hence no significant increase in post stability is achieved. Although Thomas indicates that his base plate may include openings through which stakes may be driven to hold the socket more firmly in position, this would significantly increase installation time.

U.S. Pat. Nos. 3,809,346, 4,156,332 and 4,644,713 disclose various other post anchoring devices designed to eliminate the cost and labour of preparing post holes, and to prevent the rapid deterioration of posts supported in such holes. However, none of the above-noted references teach the combined advantages of (a) supporting a post on a base plate having a surface area substantially larger than the post cross-sectional area and (b) providing a plurality of ground-penetrating stabilizing pins integrally connected to the base plate and spaced around its perimeter for enhanced stability.

Further, the prior art does not reveal anchoring devices specifically adapted for supporting hollow plastic posts which are becoming increasingly prevalent due to cost and safety factors.

SUMMARY OF THE INVENTION

In accordance with the invention, there is provided an anchoring device for supporting a post in a generally upright, vertical position. In one embodiment the anchoring device includes a base plate having a surface area substantially greater than the cross-sectional surface area of the post, at least two opposed, apertured support plates projecting upwardly from the base plate for laterally supporting the post, a ground-penetrating shaft projecting downwardly from a central portion of the base plate, and a plurality of spaced-apart, ground-penetrating stabilizing pins positioned near the perimeter of the base plate.

Preferably the surface area of the base plate is between 2 to 5 times greater than the cross-sectional area of the post. In one embodiment, the base plate is square and the stabilizing pins are positioned at at least the four corners of the base plate.

Advantageously the stabilizing pins are integrally connected to the base plate. The entire post anchoring device may be of unitary plastic construction.

In one embodiment the anchoring device may also include a downwardly projecting, ground-penetrating rim extending along the perimeter of the base plate.

The central ground-penetrating shaft preferably has a ribbed outer surface to enhance engagement with the ground.

In an alternative embodiment of the invention for use with a hollow post, the post support means comprises a pair of support plates each having closely spaced inner and outer walls separated by a vertical gap into which a wall section of the post may slide. In a further alternative embodiment, the post support means may comprise two closely spaced, square cross-sectional support plates separated by a square cross-sectional gap into which the base of the post is snugly slidably receivable.

BRIEF DESCRIPTION OF THE DRAWINGS

In drawings which illustrate various embodiments of the invention.

DETAILED DESCRIPTION OF THE PREFERRED EMBODIMENT

Figure 1:
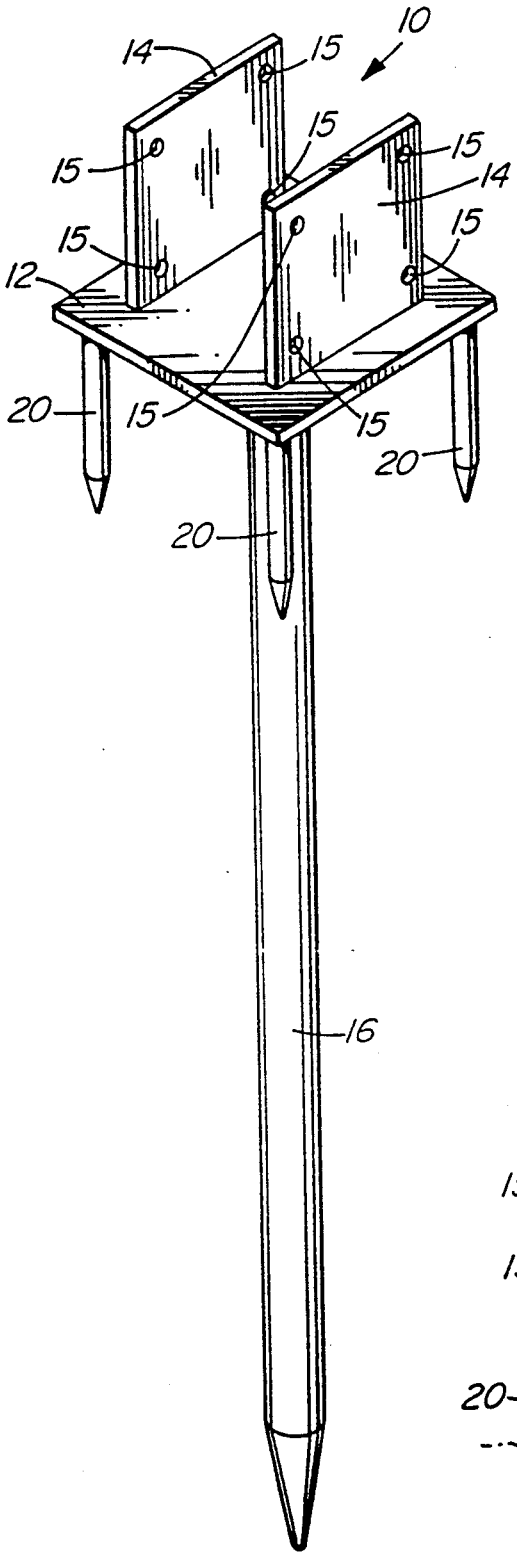
FIG. 1 is an isometric view of the post anchoring device.
Figure 2:
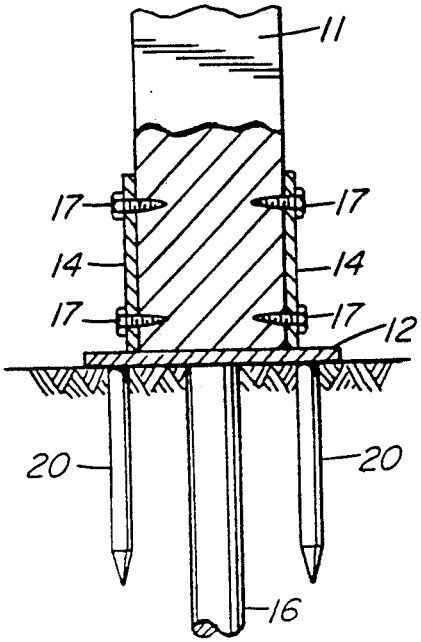
FIG. 2 is a partially fragmented, cross-sectional side view showing the anchoring device of FIG. 1 supporting a post on the ground surface.

FIGS. 1 and 2 illustrate a post anchoring device generally designated 10 for supporting a post 11 on the surface of the ground in a generally upright, vertical position. Anchoring device 10 eliminates the need to dig a hole in the ground to anchor post 11 securely in position.

Anchoring device 10 includes a base plate 12 having a surface area substantially greater than the cross-sectional area of the post 11 to be supported. Preferably, the surface area of base plate 12 is between 2 to 5 times greater than the cross-sectional surface area of post 11. For example, for a 4"×4" post 11, base plate 10 should be at least 6"×6" in dimension and preferably 8"×8" in dimension.

A pair of opposed, spaced-apart support plates 14 extend upwardly from base plate 12. As shown best in FIG. 2, support plates 14 provide lateral support for post 11. To this end, support plates 14 have a series of apertures 15 for insertion therethrough of fasteners, such as lag screws 17, directly into post 11.

Anchoring device 10 also includes a elongate, ground-penetrating shaft 16 extending downwardly from a central portion of the underside of base plate 12; and, a plurality of ground-penetrating stabilizing pins 20 spaced around the perimeter of the underside of base plate 12 and projecting downwardly therefrom. Shaft 16 and pins 20 are integrally connected to base plate 12 and are provided to maintain anchoring device 10 securely in the ground.

To anchor a 6"×6" base plate 12, shaft 16 is typically about 24" in length and pins 20 are about 6" in length. The length of shaft 16 and pins 20 may vary depending upon soil conditions. For example, a longer shaft 16 and pins 20 may be required to anchor base plate 12 in soft soil. The length of shaft 16 and pins 20 may also vary to some extent depending on the height and weight of post 11 and the load supported by post 11 (such as highway signs).

The inventor has discovered that placement of a plurality of stabilizing pins 20 around the periphery of a base plate 12 having a comparatively large surface area results in a particularly stable design which is suitable for supporting highway signs and the like. By distributing the weight of post 11 over a larger surface area, anchoring device 10 is better able to resist twisting forces acting on post 11, such as wind sheer. In other words, a higher degree of torque is required to dislodge base plate 12 from the ground. Additionally, since the downward force on base plate 12 per unit area is decreased, anchoring device 10 is less prone to sinkage in soft or sandy soil.

Figure 3:
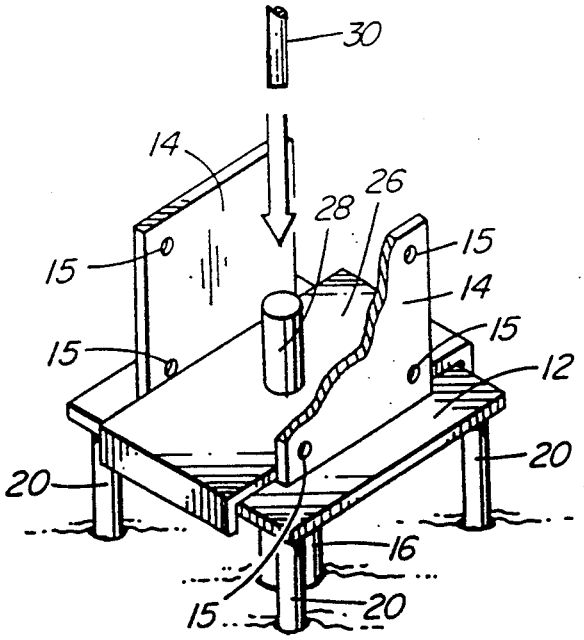
FIG. 3 is an isometric view of an inverted U-shaped bracket overlying the base plate of the anchoring device of FIG. 1 for facilitating insertion of the anchoring device into the ground using a power tool.

FIG. 3 illustrates an inverted U-shaped steel bracket 26 for use in driving anchoring device 10 into the ground using a power tool, such as a jack hammer. Bracket 26 is dimensioned to securely overlie base plate 12, between support plates 14 and includes a hollow shaft 28 for mating with a jack hammer moil point 30.

Figure 4:
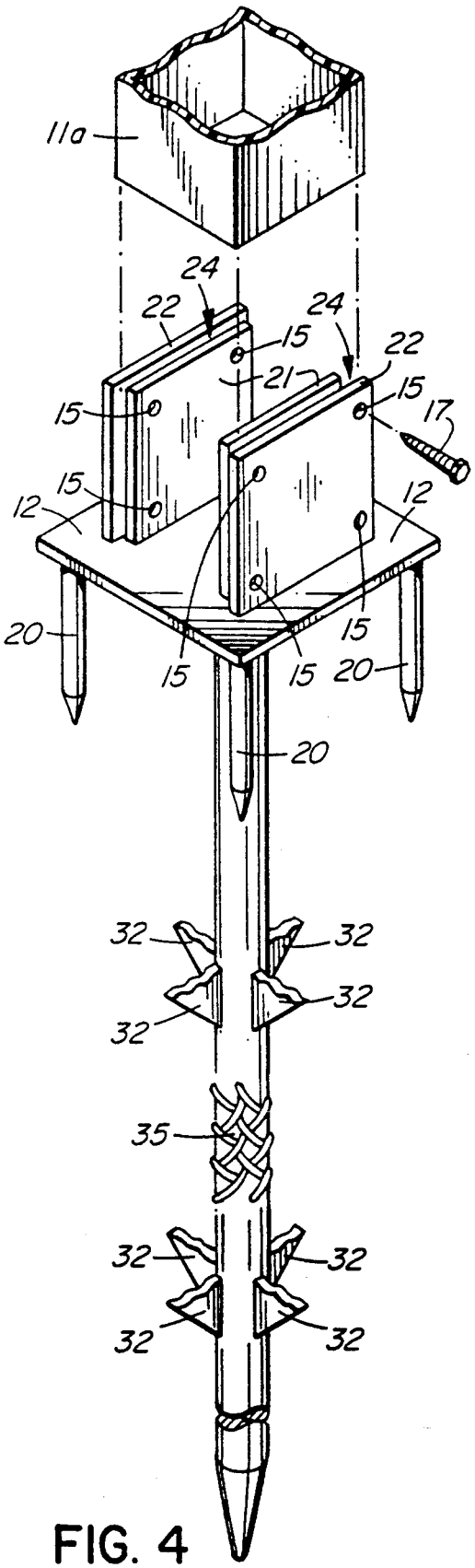
FIG. 4 is an exploded isometric view of an alternative embodiment of the invention illustrating a pair of opposed, slotted support plates for receiving a hollow post.

FIG. 4 illustrates an alternative embodiment of the invention which is specifically adapted for supporting a hollow plastic post 11(*a*). It is anticipated that hollow posts 11(*a*) will become increasingly prevalent in the future for cost and safety reasons. For example, it is believed that highway sing posts constructed from hollow plastic will result in decreased traffic fatalities since they will not splinter upon impact.

Support plates 14 illustrated in FIG. 4 comprise closely spaced inner and outer plates 21,22 separated by a gap 24 into which the wall section of post 11(*a*) may slide. After post 11(*a*) has been fitted into gaps 24, it may be releasibly secured to support plates 14 with lag screws 17, which are insertable through support plate apertures 15.

FIG. 4 also illustrates an alternative embodiment of ground-penetrating shaft 16. Shaft 16 may have a partially or completely ribbed outer surface 35 for securely engaging the ground. Preferably shaft 16 is constructed from steel re-bar. Shaft 16 may also include a plurality of laterally extending barbs 32 to restrain upward movement of shaft 16 after anchoring device 10 is driven into the ground.

Figure 5:
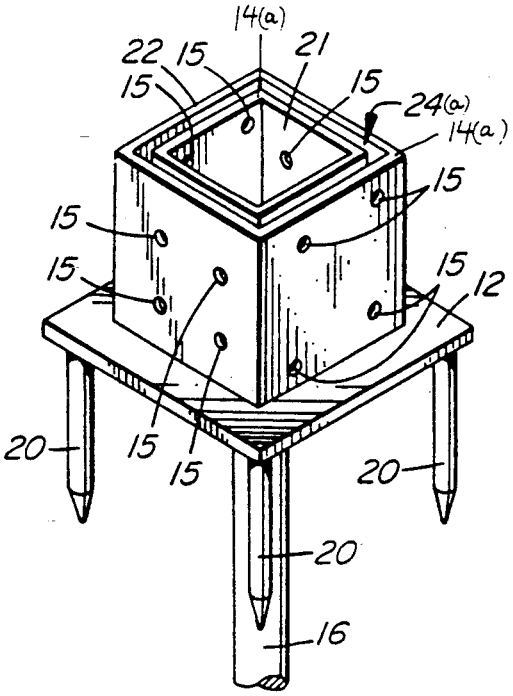
FIG. 5 is an isometric view of a further alternative embodiment of the invention illustrating a square shaped, slotted socket for receiving a hollow post.

FIG. 5 illustrates a further alternative embodiment of anchoring device 10 for anchoring a hollow post 11(*a*) having a square cross-section (FIG. 4). In this embodiment, two closely spaced, square cross-sectional support plates 14(*a*) are separated by a square cross-sectional gap 24(*a*) into which the base of post 11(*a*) is snugly slidable receivable.

Figure 6:
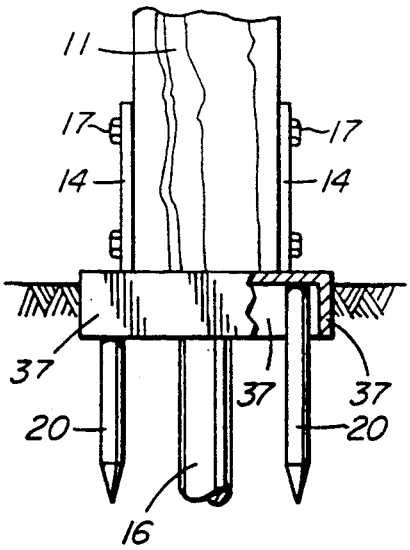
FIG. 6 is a partially fragmented, cross-sectional side view of a further embodiment of the invention illustrating a ground-penetrating rim extending around the periphery of the base plate.

Yet another alternative embodiment of anchoring device 10 is shown in FIG. 6. In this embodiment base plate 12 further includes a ground-penetrating rim 37 extending around its perimeter to provide enhanced stability.

Anchoring device 10 may be of unitary plastic construction. For example, anchoring device 10 may be fabricated at a low per unit cost using conventional injection molding technology. Although anchoring device 10 has been described and illustrated with reference to posts 11 and 11(*a*) having a square cross-section, it should be apparent that anchoring device 10 could be readily adapted to support posts having a circular, triangular or any other cross-sectional shape.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An anchoring device for supporting a post in a generally upright vertical position comprising:

a) a base plate having a surface area substantially greater than the cross-sectional surface area of said post;

b) post support means projecting upwardly from an upper surface of said base plate for laterally supporting said post, said post support means comprising at least two opposed, apertured support plates;

c) a ground-penetrating shaft integrally connected to a bottom surface of said base plate and projecting downwardly from a central portion thereof; and d) a plurality of spaced-apart, ground-penetrating stabilizing pins integrally connected to said base plate bottom surface and projecting vertically downwardly therefrom, wherein said stabilizing pins are positioned near the perimeter of said base plate.

2. An anchoring device as defined in claim 1, wherein the surface area of said base plate is between 2 to 5 times greater than the cross-sectional surface area of said post.

3. An anchoring device as defined in claim 1, wherein said base plate is square and wherein said stabilizing pins are positioned proximate at least the four corners of said base plate.

4. An anchoring device as defined in claim 1, further comprising a downwardly projecting, ground-penetrating rim extending along the perimeter of said base plate.

5. An anchoring device as defined in claim 1, wherein said shaft has a ribbed outer surface.

6. An anchoring device for supporting a hollow post in a generally upright, vertical position, comprising:

a) a base plate having a surface area substantially greater than the cross-sectional surface area of said post;

b) post support means projecting upwardly from an upper surface of said base plate, said support means defining a vertical slot for receiving a wall section of said post;

c) a ground-penetrating shaft integrally connected to a bottom surface of said base plate and projecting downwardly from a central portion thereof; and d) a plurality of spaced-apart, ground-penetrating stabilizing pins integrally connected to said base plate bottom surface and projecting vertically downwardly therefrom, wherein said stabilizing pins are positioned near the perimeter of said base plate.

7. An anchoring device as defined in claim 6, wherein said post support means comprises at least two opposed, apertured support plates, each plate comprising closely spaced inner and outer walls separated by a vertical gap for slidably receiving a wall section of said post.

8. An anchoring device as defined in claim 6, wherein said post is square in cross-section, and wherein said post support means comprises two closely spaced, square cross-sectional support plates separated by a square cross-sectional gap into which the base of said post is snugly slidably receivable.

9. An anchoring device as defined in claim 6, further comprising a downwardly projecting, ground-penetrating rim extending along the perimeter of said base plate.

10. An anchoring device as defined in claim 1, wherein said anchoring device is of unitary plastic construction.

11. An anchoring device as claimed in claim 6, wherein said anchoring device is of unitary plastic construction.

* * * * *

UNITED STATES PATENT AND TRADEMARK OFFICE

CERTIFICATE OF CORRECTION

PATENT NO. : 5,123,623

DATED : June 23, 1992

INVENTOR(S) : James F. McNamara

It is certified that error appears in the above-identified patent and that said Letters Patent is hereby corrected as shown below:

On the title page, delete item [73] Assingee: Nippon Steel Corporation, Tokoyo, Japan.

Before item [57] Abstract, the "Attorney, Agent, or Firm" should read --Barrigar & Oyen--.

Column 1, line 35, change "sing" to --sign--.

Column 3, line 54, change "sing" to --sign--.

Signed and Sealed this

Ninth Day of November, 1993

*Attest:*

*Attesting Officer*

BRUCE LEHMAN

*Commissioner of Patents and Trademarks*